US009205681B2

(12) United States Patent
Horaguchi

(10) Patent No.: US 9,205,681 B2
(45) Date of Patent: Dec. 8, 2015

(54) MEDIA CONVEYANCE CONTROL METHOD AND PRINTER

(71) Applicant: Seiko Epson Corporation, Tokyo (JP)

(72) Inventor: Norio Horaguchi, Kamiina-gun (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/581,360

(22) Filed: Dec. 23, 2014

(65) Prior Publication Data

US 2015/0174931 A1 Jun. 25, 2015

(30) Foreign Application Priority Data

Dec. 24, 2013 (JP) ..... 2013-265013

(51) Int. Cl.
*B41J 29/38* (2006.01)
*B41J 11/42* (2006.01)
*B41J 15/16* (2006.01)

(52) U.S. Cl.
CPC ..... *B41J 11/42* (2013.01); *B41J 15/165* (2013.01); *B65H 2557/2644* (2013.01)

(58) Field of Classification Search
CPC ..... B41J 15/165; B65H 2557/2644
See application file for complete search history.

(56) References Cited

U.S. PATENT DOCUMENTS

| | | | | | |
|---|---|---|---|---|---|
| 4,485,982 | A | * | 12/1984 | St. John et al. | 242/563.1 |
| 4,966,333 | A | * | 10/1990 | Bosch | 242/412.3 |
| 6,405,098 | B1 | * | 6/2002 | Mehlis et al. | 700/139 |
| 2014/0069286 | A1 | * | 3/2014 | Haushahn et al. | 101/228 |
| 2014/0132698 | A1 | * | 5/2014 | Lakin | 347/217 |

FOREIGN PATENT DOCUMENTS

| | | | | |
|---|---|---|---|---|
| GB | 551607 | A | * | 3/1943 |
| JP | 2001-278518 | A | | 10/2001 |
| JP | 2013-227142 | A | | 11/2013 |

* cited by examiner

*Primary Examiner* — Shelby Fidler
(74) *Attorney, Agent, or Firm* — Nutter McClennen & Fish LLP

(57) ABSTRACT

When conveyance of the recording paper 3 by the conveyance mechanism 12 stops, the printer 1 supplies power of a specific current level to the supply motor 25. This applies specific torque to the paper roll 2 in the opposite direction as the direction in which tension is applied to the recording paper 3 by a spring 30, and holds the movable member 27 at the same position as when conveyance of the recording paper 3 stopped. The torque applied to the paper roll 2 to hold the print position of the movable member 27 is torque sufficient to hold the paper roll 2 still without rolling, and is less than the torque required to turn the paper roll 2 to maintain constant tension on the recording paper 3. Little current is therefore supplied to the supply motor 25, and the supply motor 25 is prevented from overheating.

6 Claims, 4 Drawing Sheets

MEDIA CONVEYANCE CONTROL METHOD AND PRINTER

BACKGROUND

1. Technical Field

The present invention relates to a media conveyance control method that can suppress variation in the tension on a continuous medium delivered and conveyed from a roll, and to a printer.

2. Related Art

A printer that prints on continuous recording paper delivered from a paper roll according to the related art is described in JP-A-2001-278518, for example. The printer described in JP-A-2001-278518 has a conveyance mechanism that conveys recording paper delivered from a paper roll, a tension adjustment roller disposed on the upstream side in the conveyance direction of the recording paper from the conveyance mechanism, a motor that drives the tension adjustment roller, and a control unit that controls driving the conveyance mechanism and the motor. The control unit uses PID control to control the motor to maintain constant tension (back tension) on the recording paper between the conveyance mechanism and the roller when conveying the recording paper by the conveyance mechanism. The control unit also uses PID control to control the motor to maintain constant tension on the recording paper between the conveyance mechanism and the roller when conveyance of the recording paper by the conveyance mechanism is stopped.

If the medium is pulled in the opposite of the conveyance direction due to the inertia of the paper roll, for example, when starting to convey the media (recording paper) delivered from the roll (paper roll), the tension on the media increases. Because this increase in tension affects the conveyance precision of the media, the media is delivered from the paper roll or the media is rewound onto the roll in order to keep the tension on the medium at a specific tension level. If the tension on the medium also remains constant after media conveyance stops as described in JP-A-2001-278518, there is no need to deliver or rewind the medium at the start of media conveyance, the printing operation can therefore start quickly, and the throughput of the printing process improves.

However, if PID control of the motor continues to maintain constant tension on the medium even after media conveyance stops, the motor is driven in reaction to change in the tension on the medium even when the medium sags slightly. With PID control, however, the change in tension is time integrated and reflected in how much the motor is controlled even when there is a slight variation in tension, and the motor continues being driven even after media conveyance has stopped. Preventing the motor from heating even after media conveyance has stopped can therefore be difficult.

SUMMARY

An objective of the present invention is therefore to provide a media conveyance control method that can prevent the media supply motor that rotates the paper roll from overheating while maintaining desirable tension on the medium delivered from the paper roll after media conveyance has stopped, and to a printer.

One aspect of the invention is a media conveyance control method of a media conveyance device having a conveyance mechanism that conveys a continuous medium delivered from a roll, and a media supply motor that rotates the roll, the media conveyance control method including: positioning a movable member that moves in response to a change in the tension on the medium between the roll and the conveyance mechanism to a position urged in the direction applying tension to the medium; acquiring a positional deviation of the movable member from a target position set in the movable range of the movable member during conveyance of the medium by the conveyance mechanism; controlling driving the media supply motor based on the positional deviation to position the movable member at the target position; and supplying power to the media supply motor to apply specific torque to the roll in the opposite direction as the direction in which the movable member applies tension when conveyance of the medium by the conveyance mechanism stops.

When media conveyance by the conveyance mechanism stops, the invention applies constant torque to the paper roll by supplying power to the media supply motor, and can thereby maintain the position of the movable member. The torque applied to the paper roll to maintain the position of the movable member is sufficient to hold the roll in a static position without rolling, and is less than the torque required to rotate the roll to maintain constant tension on the medium. More specifically, because the friction of members that support the roll acts on the roll, and detent torque acts on the media supply motor, the torque required to hold the roll in a static position is low. The power supplied to the media supply motor to apply this torque to the roll is therefore less than the power required to drive the media supply motor by PID control, for example, to maintain constant tension on the medium. The media supply motor can therefore be prevented from overheating while maintaining tension on the medium after conveyance of the medium stops.

To apply a constant torque to the roll by supplying power to the media supply motor, power of a specific current level is preferably supplied to the media supply motor when conveyance of the medium by the conveyance mechanism stops.

To suppress change in the tension on the medium while conveying the medium, the invention preferably also acquires the positional deviation at a specific period during conveyance of the medium by the conveyance mechanism, and drives the media supply motor by PID control based on the positional deviation to position the movable member at the target position.

More specifically, the media supply motor is driven by PID control to rotate the paper roll during conveyance of the medium, thereby delivering the medium from the roll or rewinding the medium onto the roll to hold the movable member at a target position, and suppressing variation in the tension on the medium.

Further preferably, a media conveyance control method according to another aspect of the invention includes counting the time passed from when conveyance of the medium by the conveyance mechanism stops; and stopping power supply to the media supply motor if the counted time reaches a preset time.

If conveyance of the medium does not start again within the preset time, this aspect of the invention stops the power supply to the media supply motor and suppresses power consumption.

Another aspect of the invention is a printer including: a conveyance mechanism that conveys a continuous medium delivered from a roll; a media supply motor that rotates the roll; a movable member disposed movably between the roll and the conveyance mechanism in response to a change in the tension on the medium; an urging member that urges the movable member in the direction applying tension to the medium; a detector configured to detect the position of the movable member; a control unit that continuously or intermittently acquires a positional deviation of the movable member to a target position set in the movable range of the movable member while conveying the medium by the conveyance mechanism, and drives the media supply motor based on the positional deviation to position the movable member at the target position; and a stopped state control unit configured to supply power to the media supply motor to apply specific torque to the roll in the opposite direction as the direction in which the urging member applies tension when conveyance of the medium by the conveyance mechanism stops.

When media conveyance by the conveyance mechanism stops, the stopped state control unit of the invention can apply constant torque to the paper roll by supplying power to the media supply motor, and can thereby maintain the position of the movable member. The torque applied to the paper roll to maintain the position of the movable member is sufficient to hold the roll in a static position without rolling, and is less than the torque required to rotate the roll to maintain constant tension on the medium. The power supplied to the media supply motor to apply the torque that holds the roll still is therefore less than the power required to drive the media supply motor by PID control, for example, to maintain constant tension on the medium. The media supply motor can therefore be prevented from overheating while maintaining tension on the medium after conveyance of the medium stops.

To apply a constant torque to the roll by supplying power to the media supply motor, the stopped state control unit preferably supplies power of a specific current level to the media supply motor.

To suppress change in the tension on the medium while conveying the medium, the control unit acquires the positional deviation at a specific period, and drives the media supply motor by PID control based on the positional deviation to position the movable member at the target position.

More specifically, the media supply motor is driven by PID control to rotate the paper roll during conveyance of the medium, thereby delivering the medium from the roll or rewinding the medium onto the roll to hold the movable member at a target position, and suppressing variation in the tension on the medium.

Further preferably, the printer also has a clock unit that counts the time passed from when conveyance of the medium by the conveyance mechanism stops; and a supply power stopping unit that stops power supply to the media supply motor if the counted time reaches a preset time.

If conveyance of the medium does not start again within the preset time, this aspect of the invention stops the power supply to the media supply motor and suppresses power consumption.

Effect of the Invention

The invention prevents the media supply motor that rotates the paper roll from overheating while maintaining tension on the medium after media conveyance has stopped.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer according to the present invention is described below with reference to the accompanying figures.

Figure 1:
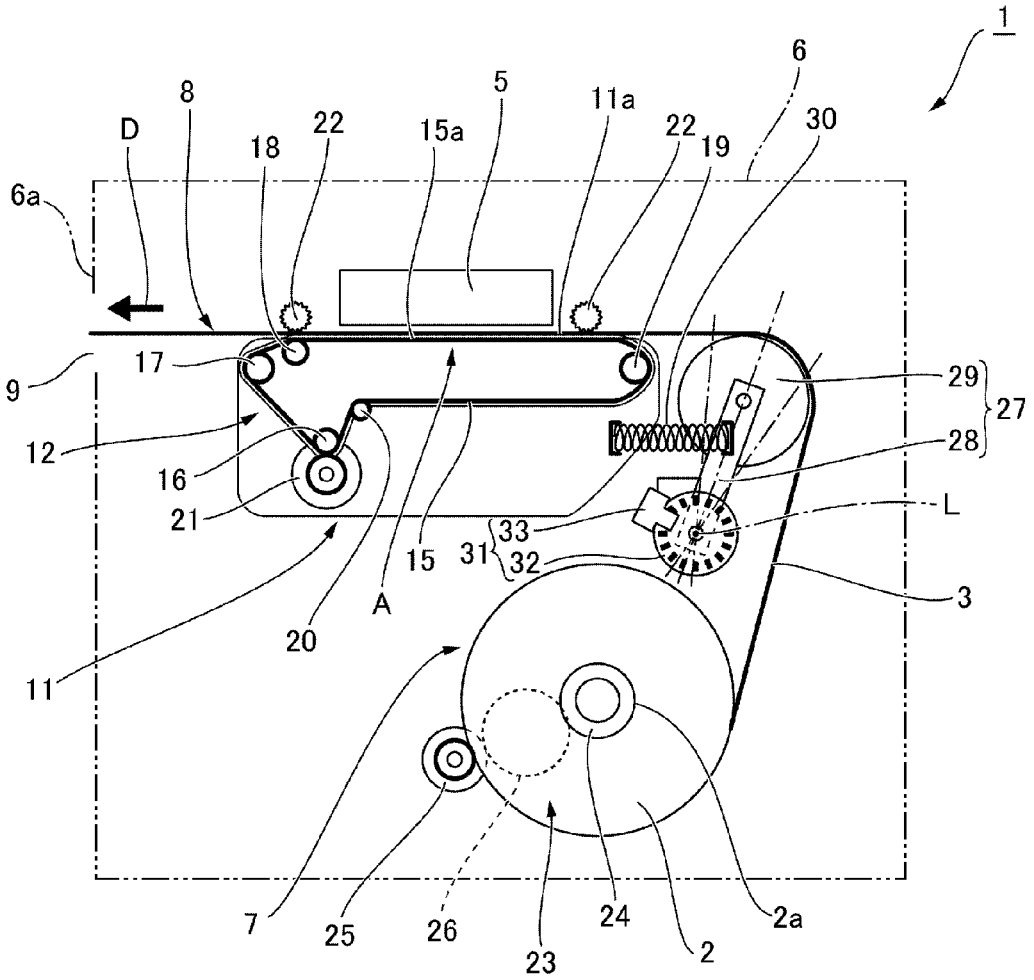
FIG. 1 illustrates the basic configuration of a printer according to the invention.
Figure 2:
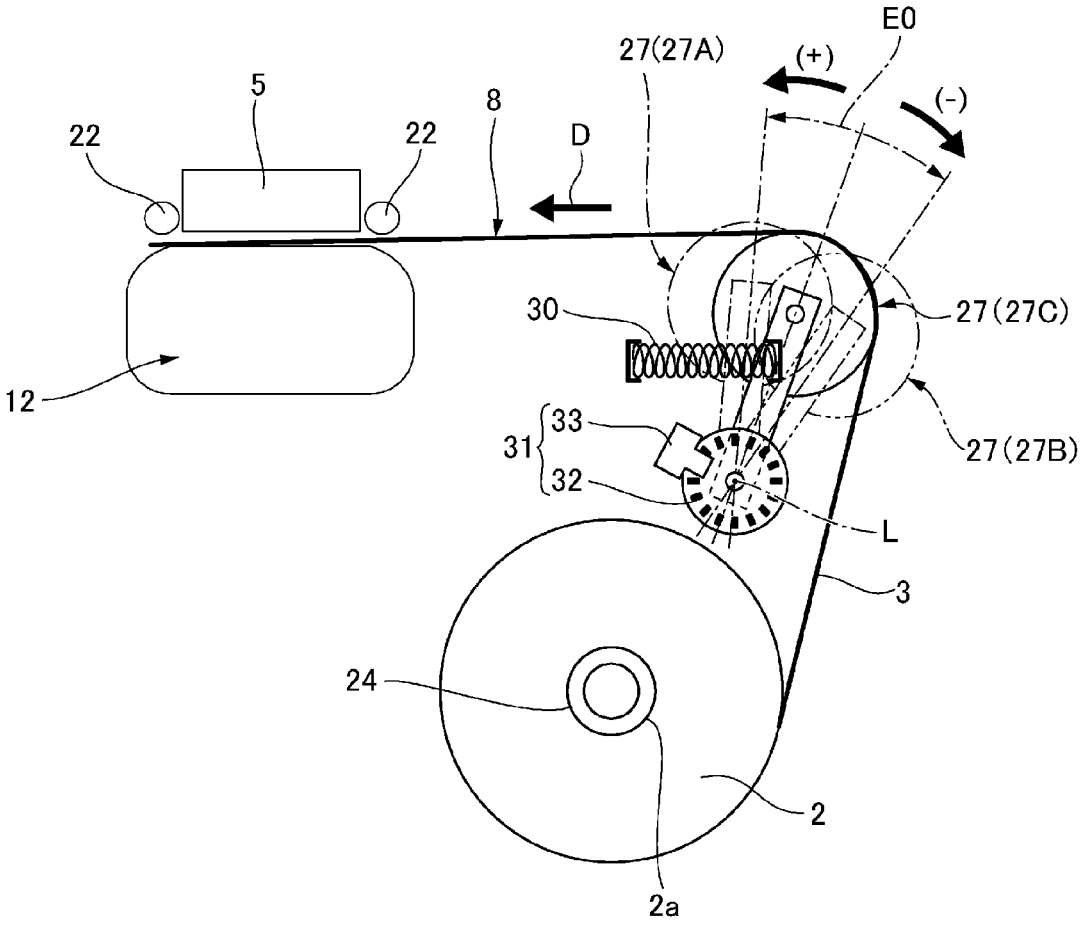
FIG. 2 illustrates the allowable movement range of the movable member.

FIG. 1 illustrates the basic configuration of a printer according to the invention. FIG. 2 illustrates the allowable movement range of the movable member.

The printer 1 in this example is a roll paper printer that prints on continuous recording paper (media) 3 delivered from a paper roll (roll) 2. The printer 1 in this example is also a line printer having an inkjet line head as the printhead 5. As shown in FIG. 1, the printer 1 has a roll paper compartment 7 that holds the paper roll 2, and a paper conveyance path 8 for conveying the recording paper 3 pulled from the paper roll 2, inside the printer case 6 indicated by an imaginary line. The paper conveyance path 8 goes from the roll paper compartment 7, past the print position A of the printhead 5, and to the paper exit 9 disposed at the top part of the front 6*a* of the printer case 6. The printhead 5 is disposed above the roll paper compartment 7.

A platen unit 11 is disposed below the printhead 5. The platen unit 11 has a platen surface 11*a* opposite the printhead 5 with a specific gap therebetween. The print position A is determined by the platen surface 11*a*. A conveyance mechanism 12 for conveying the recording paper 3 through the paper conveyance path 8 is also disposed to the platen unit 11.

The conveyance mechanism 12 includes an endless conveyance belt 15, a belt drive roller 16 on which the conveyance belt 15 is mounted, and a plurality of guide rollers 17 to 20. The conveyance mechanism 12 also includes a conveyance motor 21 as the drive source. Drive power from the conveyance motor 21 is transferred to the belt drive roller 16, and the conveyance belt 15 turns as a result of rotationally driving the belt drive roller 16.

The conveyance belt 15 has a flat belt portion 15*a* extending horizontally over the top of the platen unit 11. The flat belt portion 15*a* defines the platen surface 11*a*. Pinch rollers 22 are disposed to the flat belt portion 15*a* at the upstream end and the downstream end of the conveyance direction D. The pinch rollers 22 are pressed to the flat belt portion 15*a*, and the recording paper 3 is conveyed held between the pinch rollers 22 and the flat belt portion 15*a*.

A media supply mechanism 23 is disposed in the roll paper compartment 7. The media supply mechanism 23 includes a roll paper spindle 24 that holds the core 2*a* of the paper roll 2, and a supply motor (media supply motor) 25 for rotating the roll paper spindle 24. The supply motor 25 is a stepper motor. The supply motor 25 is driven by PWM control, and drive power therefrom is transferred through a gear train 26 to the roll paper spindle 24. When the supply motor 25 is driven and the roll paper spindle 24 turns, the paper roll 2 mounted on the roll paper spindle 24 rotates in unison with the roll paper spindle 24.

A movable member 27 that can move following change in the tension on the recording paper 3 is disposed to the paper conveyance path 8 between the roll paper compartment 7 and the conveyance mechanism 12.

The movable member 27 includes a slack lever 28 supported pivotably at the bottom end part around an axis of rotation L extending parallel to the width of the recording paper 3; and a slack roller 29 attached rotatably to the top end part of the slack lever 28. The slack lever 28 is urged to the back with a specific urging force by a compression spring (urging member) 30. More specifically, the movable member 27 is urged by the compression spring 30 in the direction applying tension to the recording paper 3.

The recording paper 3 pulled up from the paper roll 2 stored in the roll paper compartment 7 travels around the slack roller 29, and continues to the front after curving to the front along the slack roller 29.

Note that instead of using a compression spring 30, a torsion spring may be disposed to the slack lever 28 at a position around the axis of rotation L, and the slack lever 28 urged by the torsion spring in the direction moving the slack roller 29 to the back.

A rotary encoder (detector) 31 that senses the position to which the movable member 27 (slack lever 28) moves is disposed near the axis of rotation L of the slack lever 28. The rotary encoder 31 includes an encoder disc 32 that rotates in unison with the slack lever 28 around the axis of rotation L, and a detection unit 33 disposed at a fixed position opposite the outside edge of the encoder disc 32. The current position of the movable member 27 is output from the detection unit 33.

The movable member 27 moves between a tension limit position 27A where the slack lever 28 is raised to a nearly vertical position, and a slack limit position 27B where the slack lever 28 is at an angle to the back. The distance between the tension limit position 27A and the slack limit position 27B is therefore the allowable movement range (movable range) E0 of the movable member 27. The tension limit position 27A is closer to the front than the slack limit position 27B. A target position 27C is set in the middle of the direction of movement of the movable member 27 through the allowable movement range E0. The target position 27C is the target position where the movable member 27 is to be held while the recording paper 3 is being conveyed.

Control System

Figure 3:
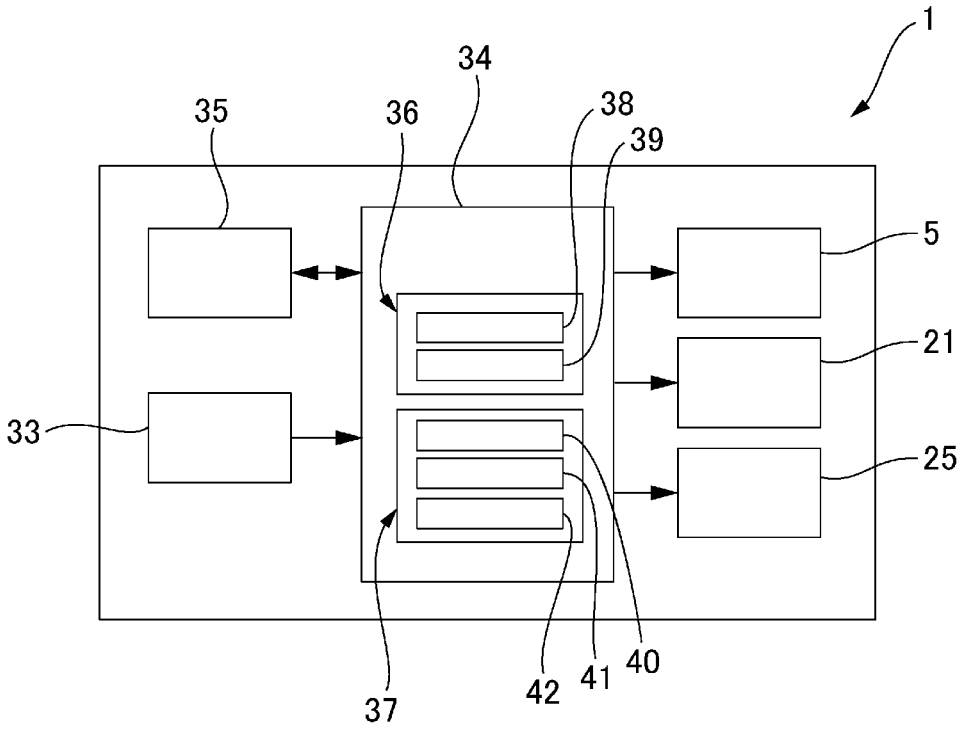
FIG. 3 is a basic block diagram of the control system of the printer shown in FIG. 1.

FIG. 3 is a block diagram showing main parts in the control system of the printer 1. The control system of the printer 1 is configured around a printer control unit 34 including a CPU and memory. A communication unit 35 that communicatively connects to an external device, and the detection unit 33 of the rotary encoder 31, are connected to the printer control unit 34. The printhead 5, conveyance motor 21, and supply motor 25 connect through drivers not shown to the output side of the printer control unit 34.

When print data is supplied from an external device through the communication unit 35, the printer control unit 34 controls driving the conveyance motor 21 and printhead 5 to print. More specifically, the printer control unit 34 controls driving the conveyance motor 21 to convey the recording paper 3 at a specific speed by means of the conveyance mechanism 12, and controls driving the printhead 5 to print the print data on the recording paper 3 while passing the print position A.

The printer control unit 34 also includes a first supply motor drive control unit 36 that controls driving the supply motor 25 when conveying the recording paper 3 by the conveyance mechanism 12, and a second supply motor drive control unit 37 that controls driving the supply motor 25 when conveyance of the recording paper 3 by the conveyance mechanism 12 stops.

The first supply motor drive control unit 36 includes a deviation acquisition unit 38 and a PID control unit 39. A value indicating the current position of the movable member 27 is input from the detection unit 33 to the deviation acquisition unit 38.

The deviation acquisition unit 38 subtracts the value indicating the current position of the movable member 27 from the value indicating the target position 27C on a predetermined specific period, and acquires the positional deviation. The value representing the target position 27C is previously stored in memory, for example. In this example, the period for determining the positional deviation is 1 ms.

The PID control unit 39 controls driving the supply motor 25 by controlling the duty of the PWM signal that drives the supply motor 25. Based on the positional deviation continuously acquired by the deviation acquisition unit 38, the PID control unit 39 applies feedback control to the supply motor 25 to reduce the positional deviation and return the movable member 27 to the target position 27C. More specifically, the first supply motor drive control unit 36 drives the supply motor 25 by PID control to rotate the paper roll 2 while the conveyance mechanism 12 conveys the recording paper 3, and thereby delivers recording paper 3 from the paper roll 2 or rewinds the recording paper 3 onto the paper roll 2, sets the movable member 27 to the target position 27C, and suppresses variation in the tension on the recording paper 3.

More specifically, the PID control unit 39 calculates the P parameter, I parameter, and D parameter based on the continuously acquired positional deviation. The P parameter is calculated based on the gain Gp of the proportional parameter and the positional deviation. The I parameter is calculated based on the gain Gi of the integral parameter and the integral of the continuously acquired positional deviation. The D parameter is calculated based on the gain Gd of the differential parameter and the integral of the continuously acquired positional deviation.

The gain Gp of the proportional parameter, the gain Gi of the integral parameter, and the gain Gd of the differential parameter are preset values. The PID control unit 39 calculates the control value totaling the calculated P parameter, I parameter, and D parameter, converts this control value to the duty of the PWM signal that drives the supply motor 25, and supplies drive current with the calculated duty to the supply motor 25. In this example, the drive current supplied to the supply motor 25 is 100 mA.

The second supply motor drive control unit 37 includes a stopped state control unit 40, a clock unit 41, and a supply power stopping unit 42. The stopped state control unit 40 supplies power of a specific current level to the supply motor 25 when conveyance of the recording paper 3 by the conveyance mechanism 12 stops. More specifically, by supplying power to the supply motor 25, the stopped state control unit 40 applies a specific torque to the paper roll 2 in the opposite direction as the direction in which tension is applied to the recording paper 3 by the compression spring 30 (the direction in which the movable member 27 moves in the negative (−) direction). As a result, the position of the movable member 27 is held at its position when conveyance of the paper roll 2 stopped.

The torque applied to the paper roll 2 to maintain the position of the movable member 27 is the torque that holds the paper roll 2 in a static position without turning, and this torque is lower than the torque that causes the paper roll 2 to turn to maintain constant tension on the recording paper 3. More specifically, friction works on the paper roll 2 between the roll paper spindle 24 that supports the paper roll 2, and the gear train 26 and frame that supports the roll paper spindle 24. Detent torque works on the supply motor 25. As a result, low torque is sufficient to maintain the paper roll 2 in a static position. Therefore, to apply the torque holding the paper roll 2 in a static position, the power supplied to the supply motor 25 can be set lower than the power applied by PID control to the supply motor 25 to maintain constant tension on the recording paper 3. In this example, the stopped position of the paper roll 2 can be held and the position of the movable member 27 maintained by supplying 10 mA of power to the supply motor 25.

The clock unit 41 counts the time from when conveyance of the recording paper 3 by the conveyance mechanism 12 stops.

The supply power stopping unit 42 stops supplying power to the supply motor 25 when the counted time reaches a preset time.

Operation in the Printing Process

Figure 4:
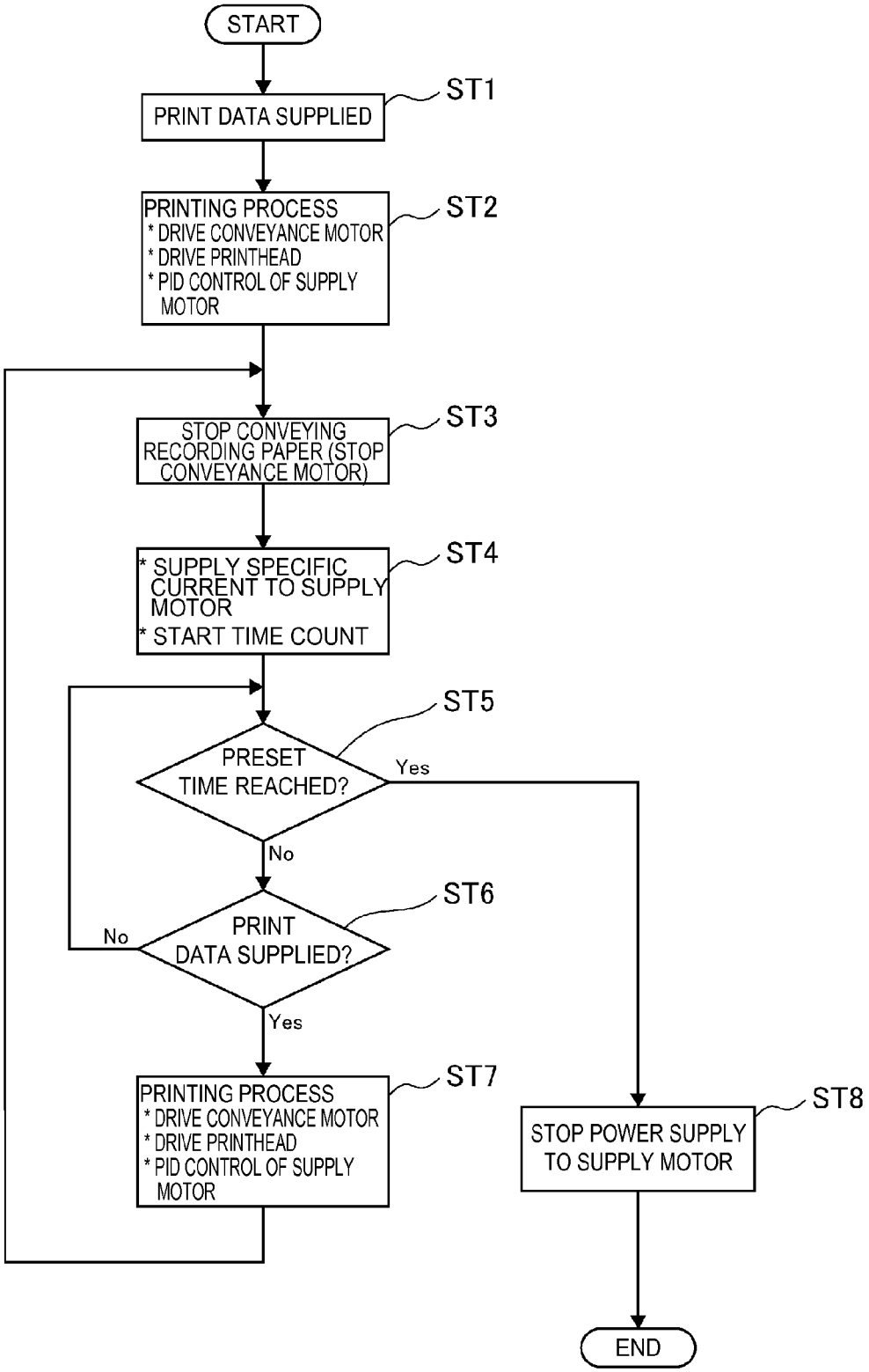
FIG. 4 is a flow chart of printer operation in the printing process.

FIG. 4 is a flow chart of the operation of the printer 1 in the printing process.

To print, the recording paper 3 is pulled up from the paper roll 2 mounted on the roll paper spindle 24, passed around the slack roller 29 of the movable member 27 to the front, and then set in the paper conveyance path 8 passing the print position A. When print data is supplied from an external device with the recording paper 3 loaded in the paper conveyance path 8 (step ST1), the printer control unit 34 drives the conveyance motor 21 to convey the recording paper 3 at a specific speed by means of the conveyance mechanism 12 and drives the printhead 5 to print the print data on the recording paper 3 as it passes the print position A (step ST2).

While printing (while conveying the recording paper 3), the first supply motor drive control unit 36 gets the positional deviation of the movable member 27 to the target position 27C, calculates the P parameter, I parameter, and D parameter based on the continuously acquired positional deviation, and drives the supply motor 25 by PID control. As a result, the first supply motor drive control unit 36 suppresses variation in tension on the recording paper 3, and suppresses variation in the conveyance speed of the recording paper 3 due to variation in the tension.

For example, when the recording paper 3 is pulled in the opposite direction as the conveyance direction D due to the inertia of the paper roll 2 while conveying the recording paper 3, the movable member 27 pivots from the target position 27C toward the tension limit position 27A. In this event, as shown in FIG. 2, the positional deviation increases in the positive (+) direction (the direction increasing tension), and the supply motor 25 is therefore driven so that recording paper 3 is delivered from the paper roll 2 in order to reduce the positional deviation. As a result, the movable member 27 returns to the target position 27C, and variation in the tension on the recording paper 3 is suppressed.

When the recording paper 3 is delivered in the conveyance direction D more quickly than the conveyance speed due to the inertia of the paper roll 2, for example, during conveyance of the recording paper 3, the movable member 27 pivots from the target position 27C toward the slack limit position 27B. In this event, as shown in FIG. 2, the positional deviation increases in the negative (−) direction (the direction decreasing tension), and the supply motor 25 is therefore driven so that recording paper 3 is taken up by the paper roll 2 in order to reduce the positional deviation. As a result, the movable member 27 returns to the target position 27C, and variation in the tension on the recording paper 3 is suppressed.

When printing ends, the recording paper 3 is conveyed until the printed portion is discharged to the outside of the paper exit 9. Driving the conveyance motor 21 then stops, and conveyance of the recording paper 3 stops (step ST3).

When driving the conveyance motor 21 stops, power of a specific current level is supplied by the stopped state control unit 40 to the supply motor 25. When driving the conveyance motor 21 stops, the clock unit 41 also starts counting the time passed from when conveyance of the recording paper 3 stopped (step ST4).

When power of the specific current level is supplied by the stopped state control unit 40 to the supply motor 25, the movable member 27 is held in the same position as when conveyance of the recording paper 3 stopped. More specifically, until conveyance of the recording paper 3 stops, the movable member 27 is controlled to the target position 27C by the first supply motor drive control unit 36. When driving the conveyance motor 21 stops (when conveyance of the recording paper 3 stops), the movable member 27 is at the target position 27C or near the target position 27C. Therefore, if driving the conveyance motor 21 stops, the movable member 27 is held at the target position 27C or near the target position 27C. As a result, the tension on the recording paper 3 is maintained at the tension when conveyance of the recording paper 3 stopped.

If PID control of the supply motor 25 continues to maintain the position of the movable member 27 after conveyance of the recording paper 3 stops, the supply motor 25 is driven and the paper roll turns reactively to the change in tension if the recording paper 3 sags slightly. If the tension on the recording paper 3 changes even slightly, this change (positional deviation) is time integrated when the I (integral) parameter is calculated, and is reflected in the control value of the supply motor 25. As a result, driving the supply motor 25 may continue even after conveyance of the recording paper 3 stops. Furthermore, the current supplied to the supply motor 25 by PID control is large. Preventing the supply motor 25 from heating after conveyance of the recording paper 3 stops is therefore difficult.

To solve this problem, the position of the movable member 27 is maintained in this example by supplying power of a specific current level to the supply motor 25 after conveyance of the recording paper 3 stops. The current level of the power supplied to the supply motor 25 after conveyance of the recording paper 3 stops is approximately 1/10 the current level of the power supplied to the supply motor 25 by PID control while conveying the recording paper 3. This embodiment of the invention can therefore prevent the supply motor 25 from overheating while maintaining the tension on the recording paper 3 after conveyance of the recording paper 3 stops.

If print data is supplied from an external device before the set time passes (step ST5 returns NO, step ST6 returns YES), printing this new print data starts (step ST7). More specifically, the printer control unit 34 drives the conveyance motor 21 to convey the recording paper 3 at a specific speed by means of the conveyance mechanism 12 and drives the printhead 5 to print the print data on the recording paper 3 as it passes the print position A. When printing ends, the process repeats from step ST3.

When conveyance of the recording paper 3 stops in this example, the movable member 27 is at the target position 27C or near the target position 27C, and the tension on the recording paper 3 is maintained at the tension when conveyance of the recording paper 3 stopped. Delivering the recording paper 3 from the paper roll 2 or rewinding the recording paper 3 onto the paper roll 2 so that the tension on the recording paper 3 is the specified tension is therefore not necessary before starting to print new print data, and printing the next print data can start quickly. The throughput of the printing process therefore improves.

If the time counted by the clock unit 41 reaches the preset time (step ST5 returns YES) after the conveyance motor 21 stops without print data being supplied from an external device (step ST5 returns NO, step ST6 returns NO), the supply power stopping unit 42 stops supplying power to the supply motor 25 (step ST8). As a result, power consumption by the printer 1 can be suppressed.

Other Embodiments

The movable member 27 in this embodiment of the invention pivots around an axis of rotation L, but a configuration in which the movable member 27 moves linearly following change in the tension on the recording paper 3 is also conceivable.

Yet further, the conveyance mechanism 12 in the above example drives the conveyance belt 15 by the conveyance motor 21 to convey the recording paper 3, but the conveyance mechanism could alternatively convey the recording paper by driving a conveyance roller by means of the conveyance motor.

The embodiment described above drives the supply motor 25 by PID control during conveyance of the recording paper 3, but the supply motor 25 may be driven by PD control or PI control. These control methods also enable supplying less power to the supply motor 25 to maintain the position of the movable member 27 after conveyance of the recording paper 3 stops than the power supplied to the supply motor 25 during conveyance of the recording paper 3.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A media conveyance control method of a media conveyance device having a conveyance mechanism that conveys a continuous medium delivered from a roll, and a media supply motor that rotates the roll, comprising:

positioning a movable member that moves in response to a change in the tension on the medium between the roll and the conveyance mechanism to a position urged in the direction applying tension to the medium;

acquiring a positional deviation of the movable member from a target position set in the movable range of the movable member during conveyance of the medium by the conveyance mechanism;

controlling driving the media supply motor based on the positional deviation to position the movable member at the target position;

supplying power to the media supply motor to apply specific torque to the roll in the opposite direction as the direction in which the movable member applies tension when conveyance of the medium by the conveyance mechanism stops;

counting the time passed from when conveyance of the medium by the conveyance mechanism stops; and stopping power supply to the media supply motor if the counted time reaches a preset time.

2. The media conveyance control method described in claim 1, wherein:

supplying power of a specific current level to the media supply motor when conveyance of the medium by the conveyance mechanism stops.

3. The media conveyance control method described in claim 1, further comprising:

acquiring the positional deviation at a specific period during conveyance of the medium by the conveyance mechanism, and driving the media supply motor by PID control based on the positional deviation to position the movable member at the target position.

4. A printer comprising:

a conveyance mechanism that conveys a continuous medium delivered from a roll;

a media supply motor that rotates the roll;

a movable member disposed movably between the roll and the conveyance mechanism in response to a change in the tension on the medium;

an urging member that urges the movable member in the direction applying tension to the medium;

a detector configured to detect the position of the movable member;

a control unit that continuously or intermittently acquires a positional deviation of the movable member to a target position set in the movable range of the movable member while conveying the medium by the conveyance mechanism, and drives the media supply motor based on the positional deviation to position the movable member at the target position;

a stopped state control unit configured to supply power to the media supply motor to apply specific torque to the roll in the opposite direction as the direction in which the urging member applies tension when conveyance of the medium by the conveyance mechanism stops;

a clock unit that counts the time passed from when conveyance of the medium by the conveyance mechanism stops; and a supply power stopping unit configured to stop power supply to the media supply motor if the counted time reaches a preset time.

5. The printer described in claim 4, wherein:

the stopped state control unit supplies power of a specific current level to the media supply motor.

6. The printer described in claim 4, wherein:

the control unit acquires the positional deviation at a specific period, and drives the media supply motor by PID control based on the positional deviation to position the movable member at the target position.

* * * * *